US011833652B2

(12) United States Patent
Britz et al.

(10) Patent No.: US 11,833,652 B2
(45) Date of Patent: Dec. 5, 2023

(54) POWER TOOL

(71) Applicant: Hilti Aktiengesellschaft, Schaan (LI)

(72) Inventors: Rory Britz, Buchloe (DE); Frank Fritsch, Kaufering (DE); Thomas Hofbrucker, Mammendorf (DE); Ernst-Rudolf Luebkert, Landsberg am Lech (DE); Kathrin Sax, Scheuring (DE); Stefan Schmid, Untermuehlhausen (DE); Aaron Wiedner, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 17/584,045

(22) Filed: Jan. 25, 2022

(65) Prior Publication Data

US 2023/0241751 A1 Aug. 3, 2023

(51) Int. Cl.
*B25D 16/00* (2006.01)
*B25D 17/08* (2006.01)

(52) U.S. Cl.
CPC ..... *B25D 16/006* (2013.01); *B25D 17/084* (2013.01); *B25D 2216/0084* (2013.01); *B25D 2250/035* (2013.01); *B25D 2250/181* (2013.01); *B25D 2250/265* (2013.01); *B25D 2250/345* (2013.01)

(58) Field of Classification Search
CPC ..... B25D 16/006; B25D 17/084; B25D 2216/0084; B25D 2250/035; B25D 2250/181; B25D 2250/265; B25D 2250/345
See application file for complete search history.

(56) References Cited

U.S. PATENT DOCUMENTS 4,114,699 A * 9/1978 Wolf ..... B25D 16/00 173/29
4,349,074 A * 9/1982 Ince ..... B25D 16/006 173/48

(Continued)

FOREIGN PATENT DOCUMENTS

DE 103 33 799 B3 2/2005
DE 10 2006 010 892 A1 9/2007

(Continued)

*Primary Examiner* — Thomas M Wittenschlaeger
*Assistant Examiner* — David G Shutty
(74) *Attorney, Agent, or Firm* — Crowell & Moring LLP

(57) ABSTRACT

A power tool for chiseling and drilling includes a housing, a motor disposed inside the housing, and a pneumatic percussion mechanism. An operation mode selector switch is disposed on the housing and has a first operation mode setting and a second operation mode setting where the first operation mode setting activates the pneumatic percussion mechanism and the second operation mode setting deactivates the pneumatic percussion mechanism. A valve has an inlet-port formed inside the guiding tube and an outlet-port formed outside the guiding tube where the valve is connected to the operation mode selector switch. The valve is closed in the first operation mode setting which disables an air exchange between the inlet-port and the outlet-port and the valve is open in the second operation mode setting which enables the air exchange between the inlet-port and the outlet-port.

7 Claims, 4 Drawing Sheets

(56) References Cited

U.S. PATENT DOCUMENTS

| | | | | | |
|---|---|---|---|---|---|
| 5,775,441 | A * | 7/1998 | Sakuragi | B25D 17/245 173/122 |
| 5,842,527 | A * | 12/1998 | Arakawa | B25D 16/006 173/104 |
| 5,954,140 | A * | 9/1999 | Bauer | B25D 16/00 173/114 |
| 5,992,541 | A * | 11/1999 | Frenzel | B25D 11/125 173/48 |
| 6,938,705 | B2 * | 9/2005 | Kikuchi | B25D 11/005 173/210 |
| 6,955,230 | B2 * | 10/2005 | Meixner | B25D 11/005 173/114 |
| 7,306,048 | B2 * | 12/2007 | Yamazaki | B25D 16/006 173/48 |
| 7,325,624 | B2 * | 2/2008 | Yamazaki | B25D 11/005 173/48 |
| 2006/0108132 | A1 | 5/2006 | Yamazaki | |
| 2006/0124333 | A1 | 6/2006 | Berger | |
| 2008/0073096 | A1 | 3/2008 | Berger et al. | |
| 2015/0290789 | A1 * | 10/2015 | Ontl | B25D 17/06 173/204 |
| 2018/0370007 | A1 * | 12/2018 | Schmid | B25D 11/005 |
| 2019/0039225 | A1 * | 2/2019 | Hartmann | B25D 17/06 |

FOREIGN PATENT DOCUMENTS

| | | | |
|---|---|---|---|
| DE | 10 2010 001 683 | A1 | 8/2011 |
| EP | 1 607 187 | A1 | 12/2005 |

* cited by examiner

POWER TOOL

BACKGROUND AND SUMMARY OF THE INVENTION

The present invention relates to a power tool, in particular to a power tool with a selectable percussion mechanism.

A hammer drill has a chuck in which a drill bit can be mounted. A motor drives a percussion mechanism repeatably striking on a rear end of the drill bit. The same motor drives the chuck for an overlaid percussive and rotational movement of the drill bit.

A power tool is chosen suitably for a specific work. Versatile power tools with two or more selectable operation modes are usable for a wider range of works. The versatile power tool with a percussion mechanism has an operation mode with the percussion mechanism activated and another operation mode with the percussion mechanism deactivated. The operator can select among the operation modes via an operation mode selector switch. The operation mode setting switch controls an actuator of the power tool which activates and deactivates the percussion mechanism accordingly. The actuator might be arranged in the power transmission path between motor and percussion mechanism, e.g., implemented as clutch, shift gear box. As being part of the power transmission path, such elements would be required to sustain high mechanical strain and wear. The power tool provides for an actuator arranged outside the transmission path.

The power tool has a housing inside which a motor and a pneumatic percussion mechanism are arranged. The pneumatic percussion mechanism has a guiding tube. A drive-piston, hammer-piston, and a pneumatic chamber are arranged inside the guiding tube. The drive-piston is reciprocatingly driven by the motor when the motor is active. The pneumatic chamber is arranged inside the guiding tube between the drive-piston and hammer-piston. The pneumatic chamber couples the movement of the drive-piston to the movement of the hammer-piston. An operation mode selector switch is arranged on the housing and has a first operation mode setting and a second operation mode setting. The first operation mode setting activates the pneumatic percussion mechanism and the second operation mode setting deactivates the pneumatic percussion mechanism. The operator can dial the operation mode setting via the operation mode selector switch.

The power tool has a valve with an inlet-port formed inside the guiding tube and an outlet-port formed outside the guiding tube. The valve is operatively connected to the mode selector switch, wherein the valve is closed in the first operation mode setting disabling an air exchange between the inlet-port and the outlet-port, and wherein the valve is opened in the second operation mode setting enabling an air exchange between the inlet-port and the outlet-port.

The valve is an actuator for activating and deactivating the pneumatic percussion mechanism arranged outside the power transmission path from motor to percussion mechanism. If the operator sets the power tool into the first operation mode setting the closed valve engages the coupling of drive-piston and hammer-piston. The air volume moved by the back-and-forth moving drive-piston cannot leave the pneumatic chamber and therefore leads to a periodic build-up of under pressure and over pressure in the pneumatic chamber. The pressure acts on the hammer-piston which therefore follows the movement of the drive-piston. If the operator sets the power tool into the second operation mode setting the open valve disengages a coupling of drive-piston and hammer-piston. The air volume, moved by the back-and-forth moving drive-piston, is enabled to enter and leave the pneumatic chamber through the open valve. The hammer-piston lacks the driving force, and the percussion mechanism does not hammer on the backside of the tool bit.

The valve does not act on the mechanical power transmission path between motor and drive-piston. The mechanical setup can be implemented with a minimal number of gears, rods, etc., as required for the active percussion mechanism. Additional gears, clutches, etc., are not required for the valve. The power tool acts differently. Contrary to power tools with a transmission path switch, the drive-piston continuously moves even though the percussion mechanism is selected to be switched off.

According to an embodiment, the axial position of the inlet-port within the tube is between the drive-piston in its position most advanced towards the chuck and the hammer-piston in its position most advanced towards the chuck without pushing a tool out of the chuck. In an embodiment the inlet-port is in a distance e relative to the drive-piston in its position most advanced towards the chuck which is larger than 25%, e.g., larger than 33%, of a travel t of the drive-piston from its position most advanced towards the chuck and its position S most distant from the chuck. In an embodiment, the inlet-port is arranged in a distance e relative to the hammer-piston in its striking position S, wherein the distance e is in a range of 10% to 50% of travel t of the hammer-piston from its striking position S to its most distant position S from the chuck. Even though the valve would be most efficient for disabling the percussion mechanism if it releases air while the air most compressed between drive-piston and hammer-piston, the valve may be covered by the hammer-piston in this phase. The valve remains sufficient enough for disabling the percussion mechanism. And, the additional opening of the inlet opening has a moderate or negligible influence on the percussion mechanism.

According to an embodiment the mode selector switch has a grip element switchable between a first position and a second position, the first position associated with the first operation mode setting and the second operation mode position associated with the second setting.

According to an embodiment the valve has a valve seat and a valve member for closing and opening the valve, the valve seat being formed as one or more radial openings in the tube and the valve member being formed by a sleeve arranged on the tube, the sleeve being slidable between a first position covering the valve seat and a second position uncovering the valve seat. The sleeve may have an inner surface in contact with the guiding tube, the inner surface has a circumferential recess which is positioned opposite the valve seat with the valve member being in the second position. Air pockets created by the inlet-port are considerably small as the valve member is in close proximity. The relation of the air pockets to the volume of the pneumatic chamber remains small.

According to one embodiment a surface area of the front surface of the drive-piston is less than ten-times larger than a cross-section area of the inlet-port.

For a better understanding of the embodiments of the present invention as well as other objects and further features thereof, reference is made to the following description which is to be used in conjunction with the accompanying drawings.

DETAILED DESCRIPTION OF THE DRAWINGS

Figure 1:
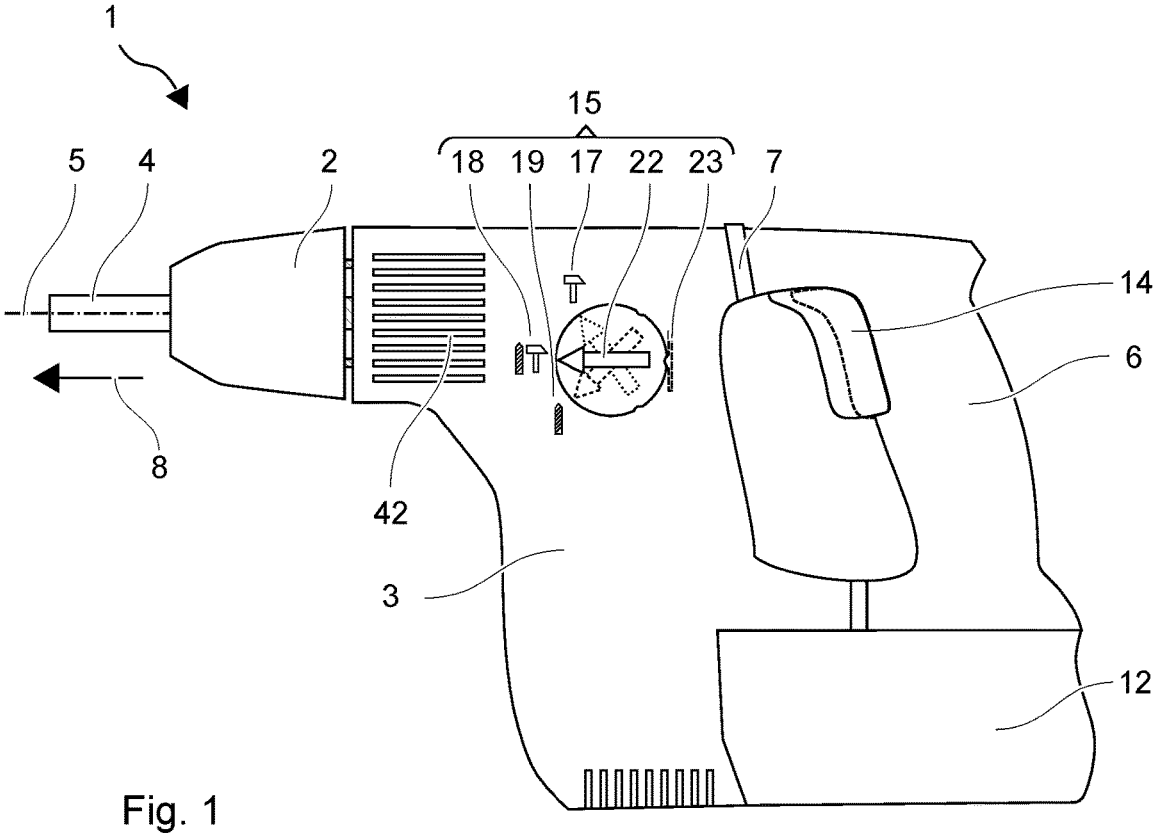
FIG. 1 is a side view of a power tool.
Figure 2:
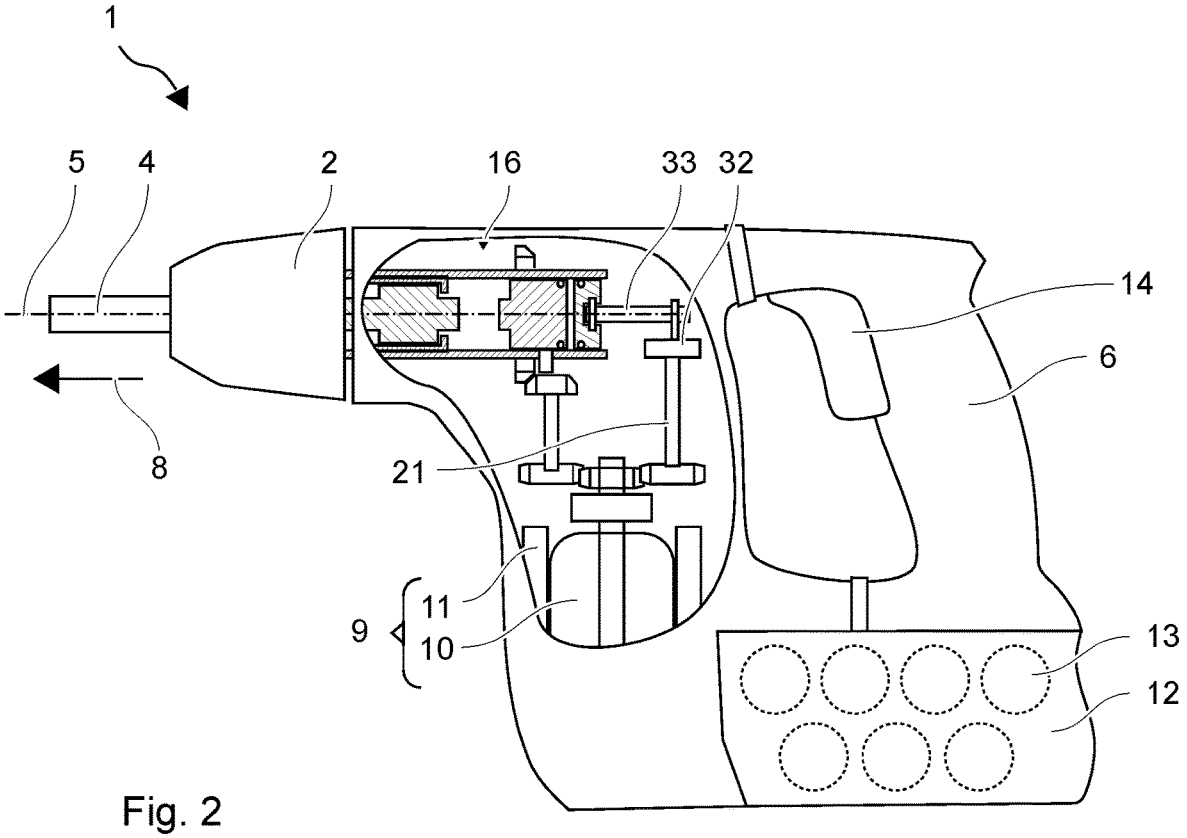
FIG. 2 is a side view of the power tool with partially removed housing.

FIG. 1 and FIG. 2 depict a power tool 1 according to an embodiment. The power tool 1 has a chuck 2 attached to a front side of the housing 3. The chuck 2 releasably mounts a tool bit 4 along its principal axis 5. The tool bit 4 can be a drill bit, a percussion drill bit, a screw bit, a chisel, or other known tools bits. The operator selects a tool bit 4 suitable for a work and changes the tool bit in chuck 2, accordingly. The chuck 2 may enable a release of a mounted tool bit 4 by manually pushing, pulling or rotating the chuck 2 relative to the housing 3 without need of key or another tool. The chuck 2 may automatically lockingly engage with an inserted tool bit 4, or may require for manually pushing, pulling or rotating the chuck 2 for a locking engagement with the tool bit 4.

The power tool 1 has a handle 6 attached to a rear side of the housing 3. The operator can hold and guide the power tool 1 during a work. The exemplary handle 6 is arranged inclined, almost perpendicular, to the principal axis 5. The operator can ergonomically apply a force on the tool bit 4 by pushing against the handle 6. The handle 6 can be partly decoupled from the housing 3 via flexible connectors 7. The connectors 7 can contain a spring-like element, e.g., a spring or a rubber cushion. The operator can compress the connector 7 in operation direction 8 such to apply pushing force. Vibrations of the power tool 1 along the principal axis 5 are damped by the connector 7. The power tool 1 may have a secondary handle arranged close to the chuck 2.

The power tool 1 has a motor 9 inside the housing 3. In an embodiment, the motor 9 is an electric motor 9 with a rotor 10 and a stator 11. The motor 9 can be a brushless or brushed motor 9. The electric motor 9 is powered by a battery pack 12. The battery pack 12 can be have one or more battery cells 13 based on Li-Ion chemistry or other chemical cells. The cells 13 can be of cylindrical or otherwise shaped. The battery pack 12 is releasably mounted on the housing 3. In another embodiment, the power tool 1 has a plug for a power grid.

A power switch 14 is arranged on the housing 3 or on the handle 6. The power switch 14 can be located on the handle 6 such that the operator can hold the handle 6 and pull the power switch 14 at the same time. The power switch 14 activates the power tool 1. The power switch 14 has an "on" trigger state (broken lines in FIG. 1) for activating the power tool 1 and an "off" trigger state (solid line) for deactivating the power tool 1. The power switch 14 is functionally connected with the motor 9. The motor 9 is powered for the switch 14 in the "on" trigger state. The rotor 10 exerts a torque against the stator 11 which results in a rotation of the rotor 10. The motor 9 is unpowered in the "off" trigger state. The power switch 14 may be a push switch that only is stable in the "off" trigger state, i.e., the power switch 14 is returning by itself to the "off" trigger state if the operator releases the power switch 14. The power switch 14 may contain a spring which pushes the power switch 14 into the "off" trigger state. In another embodiment, the power switch 14 may be a toggle switch that is stable in both trigger states.

The power tool 1 has a pneumatic percussion mechanism 16 inside the housing 3. The percussion mechanism 16 can periodically strike on a rear end of the tool bit 4 mounted in the chuck 2. The motor 9 drives the percussion mechanism 16. The power tool 1 can be used for operations requiring percussion, e.g., chiseling, and for operations without percussive action, e.g., drilling in wood. The operator can activate and deactivate the percussion mechanism 16 via an operation mode selector switch 15. The operation mode selector switch 15 has at least two operation mode settings, i.e., "with percussion" 17, 18 and "without percussion" 19. The exemplary operation mode selector switch 15 has two mode settings "with percussion" and one mode setting "without percussion". If the operator sets the operation mode selector switch 15 to "with percussion" and pulls the power switch 14 the motor 9 will be spinning and the percussion mechanism 16 will striking. If the operator sets the operation mode selector switch 15 to "without percussion" the percussion mechanism 16 will remain inactive even when the operator pulls the power switch 14 and the motor 9 is spinning.

The chuck 2 of the power tool 1 can be rotationally mounted to the housing 3 in an embodiment. The chuck 2 can be driven by the motor 9. The power tool 1 can be used for operations requiring a rotation of the tool bit 4, e.g., drilling, screwing, the percussion of the percussion mechanism 16 may be superimposed on the rotation. The operator can activate and deactivate the rotation of the chuck 2 via the operation mode selector switch 15. The operation mode selector switch 15 can have a mode setting "with rotation" 19, 18 and a mode setting "without rotation" 17. The exemplary operation mode selector switch 15 has two mode settings "with rotation" and one mode setting "without rotation". One of operation modes can superimpose "with rotation" and "with percussion", other available operation modes may be exclusively "with rotation", i.e., "without percussion", and exclusively "with percussion", i.e., and "without rotation". If the operator sets the operation mode selector switch 15 to "with rotation" and pulls the power switch 14 the motor 9 will be spinning and the chuck 2 will rotating. If the operator sets the operation mode selector switch 15 to "without rotation" the chuck 2 will remain non-rotating even when the operator pulls the power switch 14 and the motor 9 is spinning. The operation mode selector switch 15 controls an actuator 24 that applies the "with rotation" operation mode and the "without rotation" operation mode to a drive train 21 connecting the motor 9 and chuck 2.

The operation mode selector switch 14 is stable in all operation mode settings. The operation mode selector switch 15 can be implemented as a mechanical rotary switch, toggle switch, electronic switch, etc., which remains in the operation mode setting selected by the operator until the operator changes the operation mode setting via the operation mode selector switch 15. The operation mode selector switch 15 can have a grip 22 for being gripped by the operator. The grip 22 can be shifted by the operator along an axis or shifted rotatably between two, in the illustrated example three, or even more switching positions corresponding to the operation modes settings of the power tool 1. The grip 22 is arranged on a lateral side of the housing 3 to avoid inadvertent switching during operation of the power tool 1. A snap spring 23 engages with the grip 22 in switching positions. The grip 22 can only be shifted out of a switching position against a force provided by snap spring 23. The operation mode selector switch 15 controls an actuator 24 that applies the "with percussion" operation mode and the "without percussion" operation mode to the percussion mechanism 16.

Figure 3:
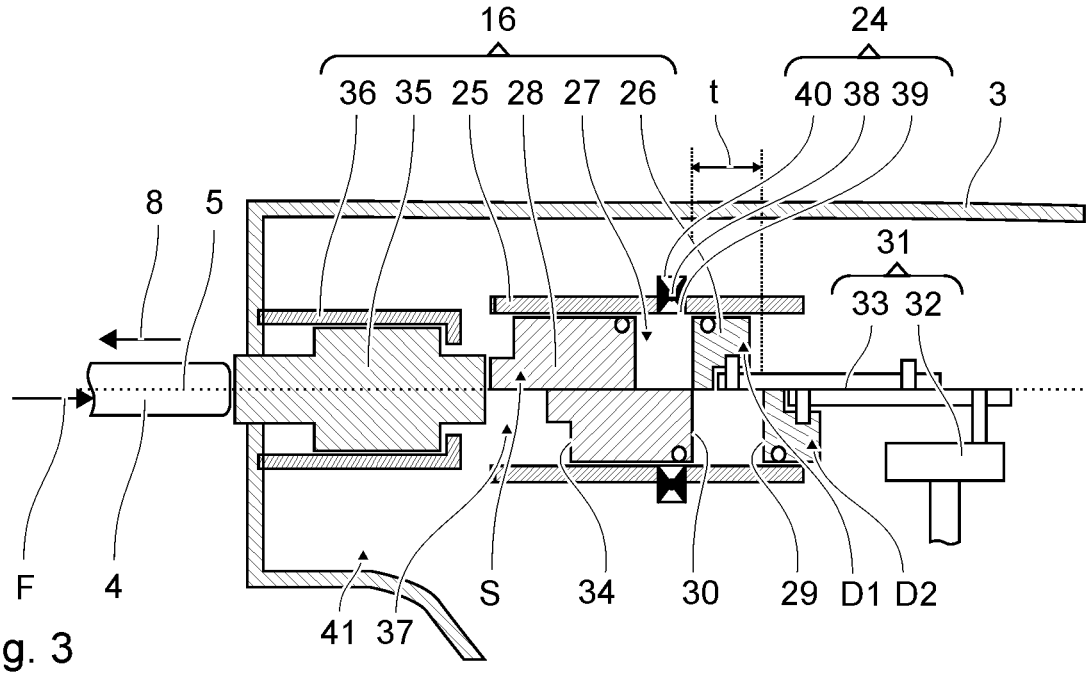
FIG. 3 is a partial view of a percussion mechanism of the power tool.

The pneumatic percussion mechanism 16 has a guiding tube 25 inside which a drive-piston 26, a pneumatic chamber 27, and a hammer-piston 28 are arranged in this order along an operation direction 8, i.e., percussion direction (FIG. 3). In an embodiment, the drive-piston 26 is arranged inside the guiding tube 25. The drive-piston 26 is movable back-and-forth along the percussion direction 8. The circumference of the drive-piston 26 is airtightly adapted to the guiding tube 25. A sealing sleeve may be fitted around a cylindric body of the drive-piston 26. The hammer-piston 28 is arranged inside the guiding tube 25 and movable back-and-forth along the percussion direction 8. The circumference of the hammer-piston 28 is airtightly adapted to the guiding tube 25. A sealing sleeve may be fitted around a cylindric body of the hammer-piston 28. An inner cross-section of the guiding tube 25 corresponds to the cross-section of the drive-piston 26 and the cross-section of the hammer-piston 28. The pneumatic chamber 27 is enclosed, along the percussion direction 8, between the frontside 29 of the drive-piston 26 and the rearside 30 of the hammer-piston 28. The air volume of the pneumatic chamber 27 equals the distance between the pistons times the inner cross-section of the guiding tube 25.

In the illustrated embodiment, both the drive-piston 26 and hammer-piston 28 can move relative to the guiding tube 25. In other embodiments, the guiding tube may be fixedly connected with either one of the drive-piston and hammer-piston forming a piston with a pot-like shape. The pot-like piston represents the guiding tube for the other piston which is arranged within the pot-like piston.

The drive-piston 26 is coupled to the motor 9. The powered motor 9 periodically moves the drive-piston 26 back-and-forth along the percussion direction 8. The drive-piston 26 oscillates between a forward turning position D1, in which the drive-piston 26 is most advanced along the percussion direction 8, and a rearward turning position D2, in which the drive-piston 26 is most rearward along the percussion direction 8. Position and distance (travel t) of the turning points are set by the drive train 31 connected the drive-piston 26. The drive train 31 converts a rotational movement of the motor 9 into a translational movement along the percussion direction 8. An exemplary drive train 31 has an eccentric wheel 32 coupled to the drive-piston 26 via a piston rod 33. Other exemplary drive trains have a wobble drive or cam drive.

The movement of the drive-piston 26 is transferred on the hammer-piston 28 via the pneumatic chamber 27. The pneumatic chamber 27 acts as pneumatic coupling. The pneumatic coupling results from pressure differences between the ambient pressure acting on a frontside 34 of the hammer-piston 28 and the air pressure acting by the pneumatic chamber 27 on a rearside 30 of the hammer-piston 28. If the air pressure inside the pneumatic chamber 27 exceeds the ambient air pressure the hammer-piston 28 is accelerated towards the anvil 35. The ambient pressure can be assumed constant, e.g., equal to the ambient pressure outside of the power tool housing 3. The air pressure inside the pneumatic chamber 27 depends on the relative distance of drive-piston 26 and hammer-piston 28, e.g., in reverse proportion to the relative distance of drive-piston 26 and hammer-piston 28, if the amount of air is encapsulated by the pneumatic chamber 27. The periodic movement of the drive-piston 26 periodically increased the inner pressure above ambient pressure and decreases the inner pressure below ambient pressure. The hammer-piston 28 is therefore excited into a periodic movement following the periodic movement of the drive-piston 26. The hammer-piston 28 moves periodically back-and-forth along the percussion direction 8 between a "striking" position S (upper half FIG. 4) and rearward turning position T(lower half FIG. 4). In the striking position S, the hammer-piston 28 contacts the anvil 35. At the rearward turning position T, the hammer-piston 28 is almost in its closest proximity to the drive-piston 26. The pressure inside the pneumatic chamber 27 reaches a peak value. The exact location of the rearward turning position T is well defined as a design parameter for the pneumatic percussion mechanism 16. The location of the rearside 30 of the hammer-piston 28 can be approximately halfway D3 of the drive-piston's frontside 29 between the drive-piston's two turning positions D1, D2.

The striking position S is defined by the anvil 35 or tool bit 4. The most forward position along the percussion direction 8 of the anvil 35 corresponds with the striking position S. If the hammer-piston 28 moves beyond the striking position S, the hammer-piston 28 starts pushing the anvil 35, and intermediary the tool bit 4, in percussion direction 8. The operator pushes the power tool 1 in percussion direction 8 against a ground which pushes tool bit 4 and anvil 35 rearwards to the percussion mechanism 16. A blocker or cage 36 for the anvil 35 defines a stop in the rearward direction 8. The anvil 35 is intended to receive the strokes of the hammer-piston 28 in the strike position S. Anvil 35 and tool bit 4 are accelerated forward into percussion direction 8 by each strike. The hammer-piston 28 elastically bounces from the anvil 35 into rearward direction.

The frontside 34 of the hammer-piston 28 faces towards an environment. The environment 37 is a hollow space that has a volume several times the volume of the pneumatic chamber 27 or is permanently connected to such larger volume, e.g., the environment outside the housing 3. The pressure changes inside the environment 37, due to the movement of the hammer-piston 28, are at least a magnitude smaller than the pressure differences inside the pneumatic chamber 27 due to the movement of the drive-piston 26.

In an embodiment, the chuck 2 is coupled to the motor 9 via the guiding tube 25. The guiding tube 25 transmits torque from the motor 9 to the chuck 2. Thus, the guiding tube 25 is revolving in a "with rotation" operation mode.

Figure 4:
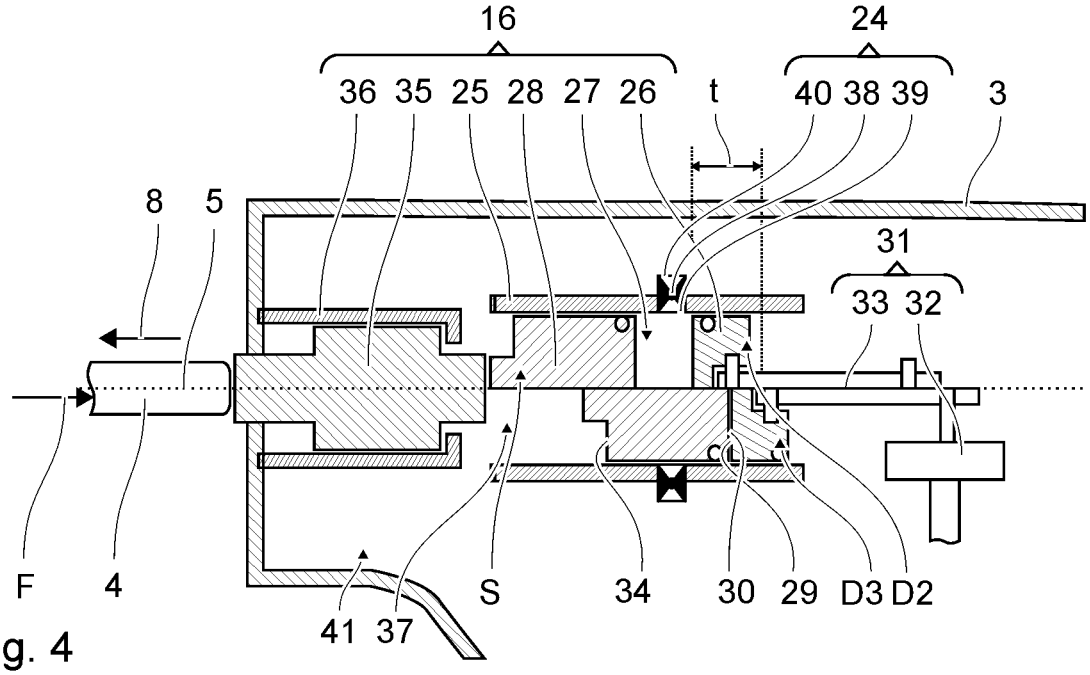
FIG. 4 is a partial view of the percussion mechanism of the power tool.

FIG. 3, FIG. 4 illustrate an embodiment with an actuator 24 for applying the operation modes to the percussion mechanism 16. The actuator 24 is embodied as a valve 38 which is connected to the pneumatic percussion mechanism 16. The valve 38 has an inlet-port 39 arranged inside the pneumatic chamber 27, for at the least the case with hammer-piston 28 located in its striking position S and the drive-piston 26 located in its rearward turning point D2. The outlet-port 40 is outside the guiding tube 25 Air from within the percussion mechanism 16 enters the valve 38 via the inlet-port 39 and leaves the valve 38 via the outlet-port 40 to an area 41 outside the guiding tube 25. The air flow within the valve 38 is controlled by an operative state of the valve 38. The valve 38 has a "closed" operative state which disables air flow from the inlet-port 39 to the outlet-port 40; and the valve 38 has an "open" operative state which enables air flow from the inlet-port 39 to the outlet-port 40. The operative state of the valve 38 is controlled by the operation mode selector switch 15. The valve 38 is set to the "open" operative state for the "without percussion" operation mode of the operation mode selector switch 15 and the valve 38 is set to the "closed" operative state for the "with percussion" operation mode of the operation mode selector switch 15. The control of the valve 38 by the operation mode selector switch 15 can be effected mechanically or electronically. The operation mode "with percussion" results in a closed valve 38, the encapsulated percussion chamber 27 acts as pneumatic coupling between drive-piston 26 and hammer-piston 28. The operation mode "without percussion" results in an open valve 38. The valve 38 creates a controlled leakage for the air inside the pneumatic chamber 27. Air can flow from inside the percussion chamber 27 to the outside of the guiding tube 25, i.e., into an environment 41. The air pressure in the environment 41 is almost constant, independent of the operation of the percussion mechanism 16. The air pressure may correspond to the ambient pressure. Air will flow out of the pneumatic chamber 27 if there is a pressure difference between inside the pneumatic chamber 27 and outside the pneumatic chamber 27, i.e., of the environment 41. The air flow reduces the pressure difference built up by the moving drive-piston 26. The pneumatic coupling of the hammer-piston 28 to the drive-piston 26 is deactivated. The hammer-piston 28 is not subjected to a pressure difference over its rearside 30 and frontside 34, hence, is no longer forced into a movement and stops moving. The open valve 38 results in an inactive percussion mechanism 16.

The environment 41 can be a typical hollow space within the housing 3 which has a volume significantly larger than the pneumatic chamber 27, e.g., areas around the motor 9, electronic components. The environment 41 can be connected via vents 42 to space outside the housing 3. The environment 41 may be connected to or be equal to the environment 37 in contact with the frontside of the hammer-piston 28.

Figure 5:
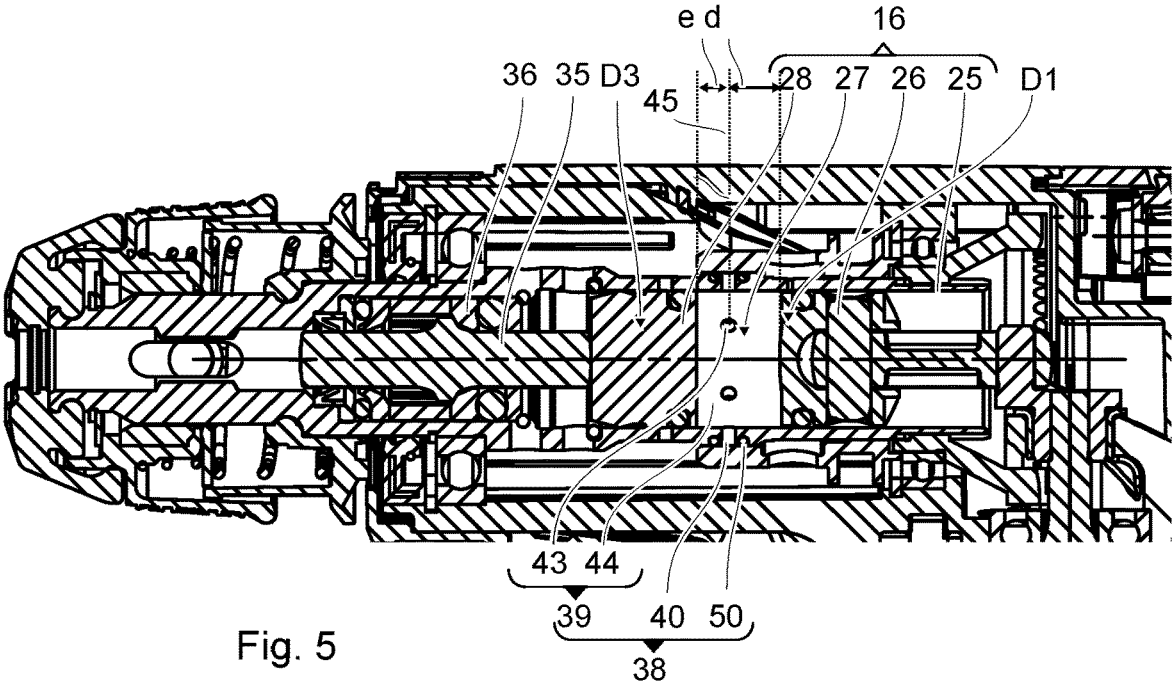
FIG. 5 is a partial view of a percussion mechanism of a power tool.

FIG. 5 illustrates the valve 38 in greater detail. The inlet-port 39 of the valve 38 is arranged inside the pneumatic chamber 27. The inlet-port 39 is at least inside the pneumatic chamber 27 in its maximal extension, i.e., with the hammer-piston 28 located in its striking position S and the drive-piston 26 located in its rearward turning point D2. The inlet-port 39 includes of holes 43 which are formed into the inner radial surface 44 of the guiding tube 25. An illustrated embodiment has six holes 43, other embodiments may have different numbers of holes, e.g., more than two holes, less than ten holes. The holes 43 can be arranged symmetrically around the percussion axis 5. The holes 43 can be arranged in equal positions along the percussion axis 5, i.e., in a single plane 45 which is perpendicular to the percussion axis 5. In other embodiments, the holes can be arranged with an offset along the percussion axis 5 with respect to their neighbors. The offset can be equal or less than a diameter of the holes. The inlet-port 39 is arranged in a distance d to the forward turning point D1 of the drive-piston 26. The drive-piston 26 does not reach the inlet-port 39 and, hence, does not cover the inlet-port 39 during its back-and-forth movement. The distance d is larger than 25% of the drive-piston's travel t, e.g., larger than 33% of the travel. The distance d is smaller than 75% of the travel, e.g., smaller than 66% of the travel. The distance d is measured with respect to the front surface 29 of the drive-piston 26. The inlet-port 39 is arranged offset by a distance e against the striking direction 8 with respect to the striking position S of the hammer-piston 28. The inlet-port 39 is uncovered when the hammer-piston 28 is in its striking position S. The distance d1 can be smaller than the travel of the hammer-piston 28 during its periodic back-and-forth movement. Thus, the hammer-piston 28 can periodically cover and uncover the inlet-port 39 with respect to the pneumatic chamber 27. In an embodiment, the hammer-piston 28 covers the inlet-port 39 in the high-pressure phase of the pneumatic chamber 27. The distance e is larger than 10% and less than 50% of the travel of the hammer-piston 28, e.g., less than 25% of the travel. The distance e is measured with respect to the rearside 30 of the hammer-piston 28. A cross-section of the inlet-port 39 is between 5% to 20% of the inner cross-section of the guide tube 25. The cross-section is accumulated over all holes 43 of the inlet-port 39.

The outlet-port 40 is arranged outside the guiding tube 25 and inside the power tool housing 3. A cross-section of the outlet-port 40 is approximately equal to the cross-section of the inlet-port 39, e.g., the cross-sections differ by less than 20%, e.g., less than 10%.

Figure 6:
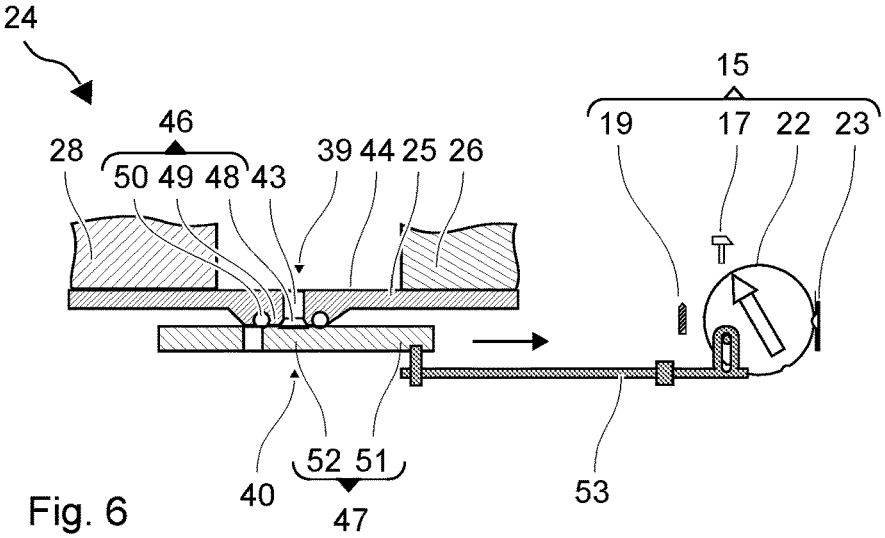
FIG. 6 is a schematic view of the valve of FIG. 4, in a closed state.
Figure 7:
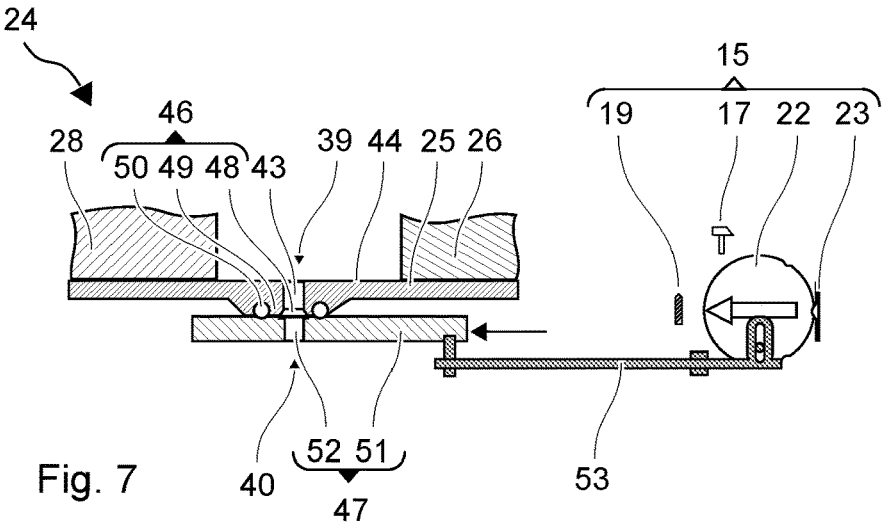
FIG. 7 is a schematic view of the valve of FIG. 4, in an open state.

The exemplary valve 38 has a valve seat 46 and a valve member 47 as illustrated in the partial view of FIG. 6 and FIG. 7. The valve seat 46 is in air flow connection with the inlet-port 39. The valve member 47 is in air flow connection with the outlet-port 40. The operation mode selector switch 15 shifts the valve member 47 relative to the valve seat 46 such that an air flow connection between valve seat 46 and valve member 47 is either established or inhibited. The valve seat 46 is arranged on the radially outer surface 48 of the guiding tube 25. The valve seat 46 can be positioned in the same plane as the inlet-port 39. The holes 43 of the inlet-port 39 can radially extend to the outer surface and by such forming the valve seat 46. The exemplary valve seat 46 has a circular groove 49 in the outer surface 48 which interconnects the individual holes 43. Seals 50, e.g., rubber o-rings, can be arranged in parallel on both sides of the circular groove 49. The valve seat 46 can be stationary with respect to the guiding tube 25 and, hence, revolve with the guiding tube 25 around the percussion axis 5. The valve member 47 has a sleeve 51 arranged in contact with the valve seat 46. The sleeve 51 is shiftable by the operation mode selector switch 15 with respect to the valve seat 46. In a first position (FIG. 6) along the percussion axis 5, the sleeve 51 fully covers the valve seat 46. The valve seat 46 is airtightly sealed by the sleeve 51 in its first position. The valve 38 is in the "closed" operative state. In a second position (FIG. 7), the sleeve 51 only partly covers with the valve seat 46. The valve seat 46 is not sealed and air can flow from the inlet-port 39 to the outlet-port 40, i.e., the valve 38 is in the "open" operative state. The exemplary valve member 47 has a sleeve 51 with several radial through holes 52. The only partial coverage of the valve seat 46 is established by aligning the through holes 52 with the valve seat 46, e.g., its circular groove 49. The radial outer end of the through holes 52 can form the outlet-port 40. The valve seat and the valve member are exemplary. Another valve member may have, on its surface towards a cooperating valve seat, a radial groove interconnecting radial through holes. The cooperating valve seat can have radial through holes, only. Another valve member can be completely retracted from the valve seat for the "open" operative state. Another valve member is rotatable shifted with respect to the valve seat between the different operative states.

A mechanical transmission linkage 53 operationally connects the valve member 47 with the operation mode selector switch 15. The mechanical transmission linkage 53 transmits a movement of the operation mode selector switch 15 into a movement of the valve member 47. The transmission linkage 53 can include rods, switching sleeves, cams, and other mechanical gear.

Figure 8:
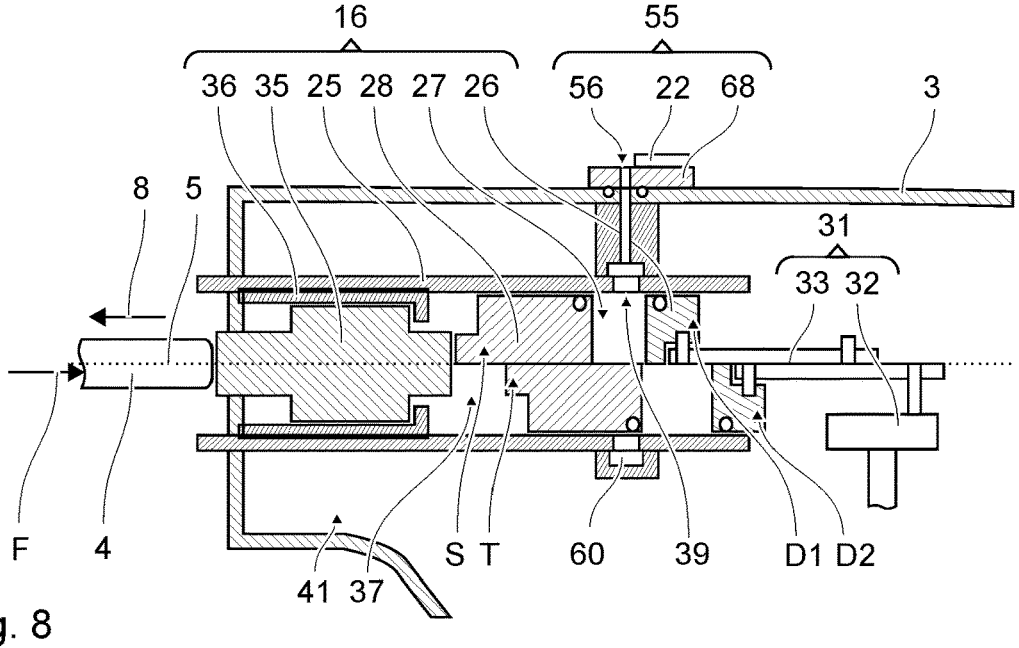
FIG. 8 is a partial view of a percussion mechanism of a power tool.

FIG. 8 shows another exemplary actuator 54. The actuator 54 is based on a valve 55 which arranged on the housing 3. The valve 55 has an inlet-port 39 and an outlet-port 56. The inlet-port 39 is arranged inside the pneumatic chamber 27. The inlet-port 39 is implemented as described with the previous embodiments. The outlet-port 56 is arranged outside the power tool housing 3. The outlet-port 56 is based on an opening 57 in the housing 3.

Figure 9:
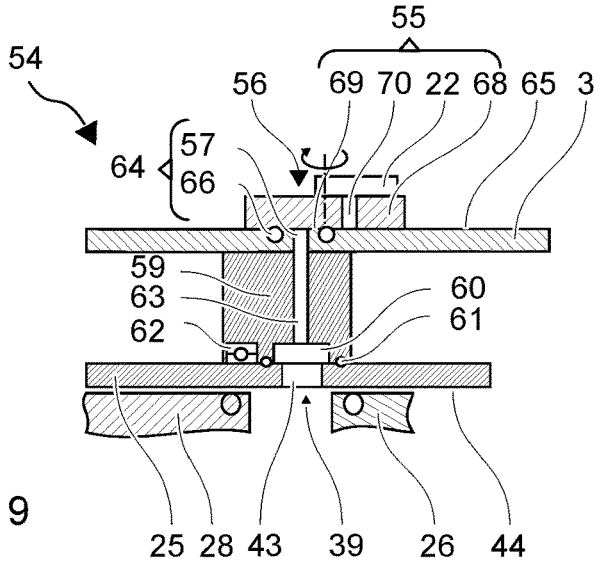
FIG. 9 is a schematic view of the valve of FIG. 4, in a closed state.
Figure 10:
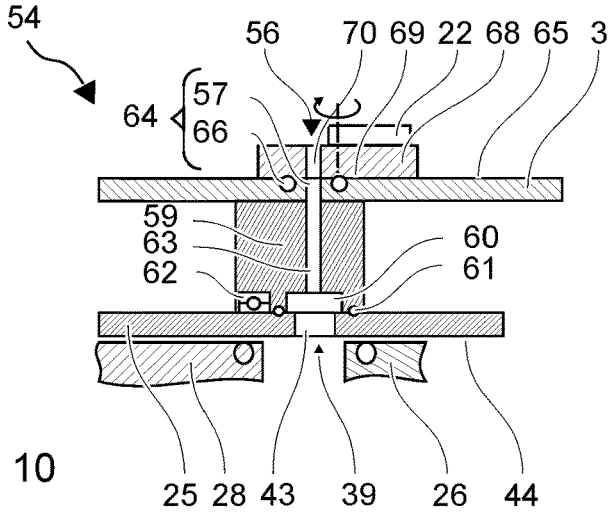
FIG. 10 is a schematic view of the valve of FIG. 4, in an open state.

FIG. 9 and FIG. 10 show a section of the actuator 54 in greater detail. The inlet-port 39 is connected via a flange 59 to the opening 57 in the housing 3. The flange 59 surrounds the guiding tube 25 in the area of the radial holes 43. The flange 59 can have a circular groove 60 which is aligned with the radial outer ends of the radial holes 43. The circular groove 60 interconnects the radial holes 43. The flange can be rotationally fixed on the guiding tube 25. The flange 59 of the illustrated embodiment allows for a relative rotation of the guiding tube 25 inside the flange 59. Seals 61, e.g., o-rings, can air-tightly seal the flange 59 to the guiding tube 25. The flange 59 may contain a bearing 62 for supporting the guiding tube 25 inside the housing 3. The flange 59 is connected to the inside of the housing 3 around the opening 57 in the housing 3. A channel 63 in the flange 59 connects the inlet-port 39 to the opening 57.

The valve 55 has a valve seat 64 arranged on an outer surface 65 of the housing 3. The valve seat 64 includes the opening 57. A seal 66 may surround the opening 57 on the outer surface 65. The operation mode selector switch 15 forms a valve member 67 connecting and disconnecting the opening 57 to the outlet-port 56. The exemplary operation mode selector switch 15 has a grip 22 and a body 68. The body 68 may be in the shape of a disk or a pad. A lower side 69 of the body 68 contacts via its lower side 69 the outer surface 65 of the housing 3. The operator can slide the body 68 on the housing 3 into different positions which correspond to selectable operation modes as described in previous embodiments. The operation mode selector switch 15 and its body may be rotatable around an axis or slidable along an axis. In a first position, the body 68 seals the opening 57 and thus setting the valve 55 in the "closed" operative state. In a second position, the body 68 does not cover or only partly covers the opening 57 and thus setting the valve 55 in the "open" operative state. A through hole 70 or cut-out may be formed into the body 68. One end of the through hole 70 is at the lower side 69 of the body 68, the other end forms the outlet-port 56. The through hole 70 is aligned with the opening 57 for the "open" operative state. Thus, an air path from the inlet-port 43 to the outlet-port 56 via the flange 59 and the operation mode selector switch 15 is established.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A power tool for chiseling and drilling, comprising:

a housing;

a motor disposed inside the housing;

a pneumatic percussion mechanism, wherein the pneumatic percussion mechanism includes a guiding tube, a drive-piston disposed inside the guiding tube and reciprocatingly driven by the motor when the motor is active, a hammer-piston disposed inside the guiding tube, and a pneumatic chamber disposed inside the guiding tube between the drive-piston and the hammer-piston, wherein the pneumatic chamber couples a movement of the hammer-piston to a movement of the drive-piston;

an operation mode selector switch disposed on the housing and having a first operation mode setting and a second operation mode setting, wherein the first operation mode setting activates the pneumatic percussion mechanism and the second operation mode setting deactivates the pneumatic percussion mechanism; and a valve having an inlet-port formed inside the guiding tube and an outlet-port formed outside the guiding tube, wherein the valve is connected to the operation mode selector switch, wherein the valve is closed in the first operation mode setting which disables an air exchange between the inlet-port and the outlet-port, and wherein the valve is open in the second operation mode setting which enables the air exchange between the inlet-port and the outlet-port;

wherein the valve has a valve seat and a valve member for closing and opening the valve, wherein the valve seat is formed as one or more radial openings in the guiding tube, wherein the valve member is formed by a sleeve disposed on the guiding tube, and wherein the sleeve is slidable between a first position covering the valve seat and a second position uncovering the valve seat;

wherein the sleeve has an inner surface in contact with the guiding tube and wherein the inner surface has a circumferential recess which is positioned opposite the valve seat with the valve member in the second position.

2. The power tool according to claim 1, wherein the drive-piston has a first position which is most advanced towards a chuck and the hammer-piston has a position most advanced towards the chuck and wherein the inlet-port is disposed between the drive-piston in the first position and the hammer-piston in the position.

3. The power tool according to claim 2, wherein the drive-piston has a travel distance from the first position to a second position which is most distant from the chuck and wherein the inlet-port is in a distance relative to the drive-piston which is larger than 25% of the travel distance.

4. The power tool according to claim 1, wherein the motor is active both in the first operation mode setting and the second operation mode setting and the drive-piston is connected to the motor in the first operation mode setting and the second operation mode setting.

5. The power tool according to claim 1, wherein a chuck for mounting a tool bit is rotatably disposed at a front of the housing and is rotationally drivable by the motor.

6. The power tool according to claim 1, wherein a surface area of a front surface of the drive-piston is less than ten-times larger than a cross-section area of the inlet-port.

7. The power tool according to claim 1, wherein a sealing sleeve is circumferentially clasped around the guiding tube.

* * * * *